United States Patent [19]

Scarnato

[11] 3,939,888

[45] Feb. 24, 1976

[54] HERMETICALLY SEALABLE COLLAPSIBLE CONTAINER

[76] Inventor: Thomas J. Scarnato, 381 Valley Road, Barrington, Ill. 60010

[22] Filed: Sept. 19, 1974

[21] Appl. No.: 507,586

Related U.S. Application Data

[63] Continuation-in-part of Ser. No. 162,551, July 14, 1971, abandoned, and a continuation-in-part of Ser. No. 324,756, Jan. 18, 1973, abandoned.

[52] U.S. Cl. ..... 150/.5

[51] Int. Cl.[2] ..... B65D 37/00

[58] Field of Search ..... 215/1 C; 150/.5; 222/107, 222/215

[56] References Cited

UNITED STATES PATENTS

| | | | |
|---|---|---|---|
| 1,811,574 | 6/1931 | Barrett | 150/.5 UX |
| 2,685,316 | 8/1954 | Krasno | 150/.5 |
| 2,899,110 | 8/1959 | Parker | 150/.5 X |
| 3,083,877 | 4/1963 | Gash | 222/107 |
| 3,143,429 | 8/1964 | Swanson | 215/1 C UX |
| 3,199,701 | 8/1965 | Santelli | 215/1 C |
| 3,434,589 | 3/1969 | Valtri | 150/.5 X |
| 3,547,294 | 12/1970 | Williams | 215/1 C |

*Primary Examiner*—Donald F. Norton
*Attorney, Agent, or Firm*—Heise & Coolahan

[57] ABSTRACT

A resuable container made of elastic material which is formed with sections of different geometry wherein when the container is opened it will self-expand to a fully extended position. However, when pressure is applied to the top of said container it will progressively collapse from the top to the bottom thereof thereby allowing reduction of volumetric dimension substantially equal to the substance contained therein for easy access to that substance. An air tight closure is tightened about the access opening while the container is held in collapsed condition whereby a partial vacuum is then created therein.

20 Claims, 4 Drawing Figures

HERMETICALLY SEALABLE COLLAPSIBLE CONTAINER

This application is a continuation-in-part of my application Ser. No. 162,551 filed July 14, 1971 and a continuation-in-part application Ser. No. 324,756 filed Jan. 18, 1973, both now abandoned.

DISCUSSION OF THE ART

As far as is known to the inventor, there has heretofore never been known a container which is self-expanding and which is collapsible to the volume of material remaining in the container, and which self-indicates an imperfect seal. Rigid containers are available which have plastic caps adapted to snap over their access openings. Their deficiency is twofold, one that they are not good seals and secondly, as the volume of perishable food diminishes through use, the volume of air trapped between the cap and the surface of the food increases. If the container is large and the opening and closings are frequent, a change of air occurs at every opening and thus the food spoilage is accelerated.

A general object of the present invention is to provide a novel collapsible container in which the geometry of the container itself effects a progressive collapsing from top to bottom upon pressure being applied to the top thereof.

A specific object of the invention is to provide a container made of an inert plastic substance such as polyethylene and like class of materials and to so construct the body of the container that it can be readily collapsed and sealed.

A further object is to provide a container having an accordion type body having a truncated configuration so that it may be compressed, and which is self-expanding so as to create a vacuum in the container upon sealing the same.

A still further object of the invention is to provide a container having a liner or coating about the body thereof to prevent the permeability of gas through the walls of said container.

A still further object of the invention is to provide a container with indicia which would readily inform the user of loss of vacuum. These and other objects and advantages inherent in and encompassed by the invention will become more readily apparent from the specifications and the drawings wherein.

DESCRIPTION OF THE PREFERRED EMBODIMENT

Figure 1:
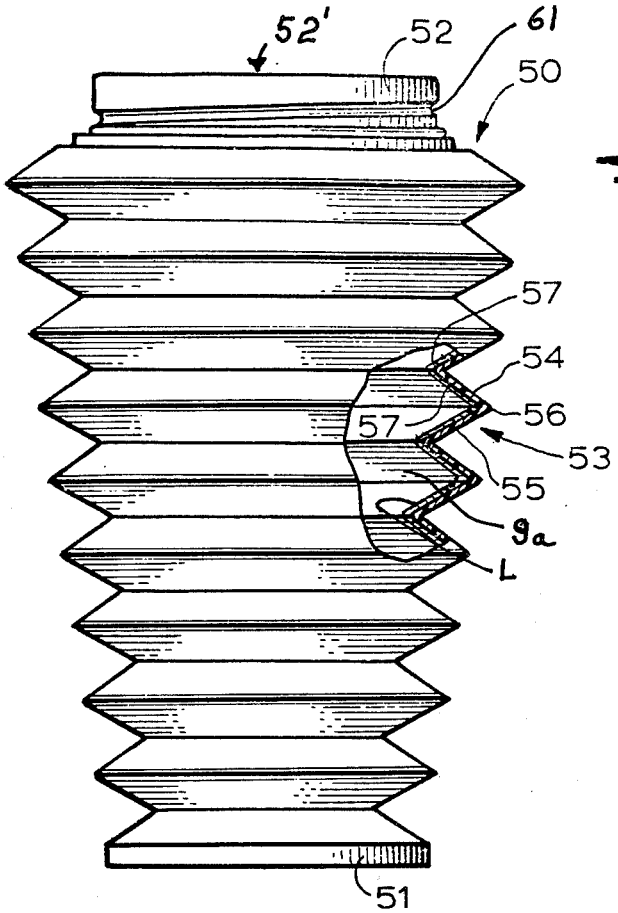
FIG. 1 is a side elevational view partly in axial section of the preferred form of my novel container.
Figure 2:
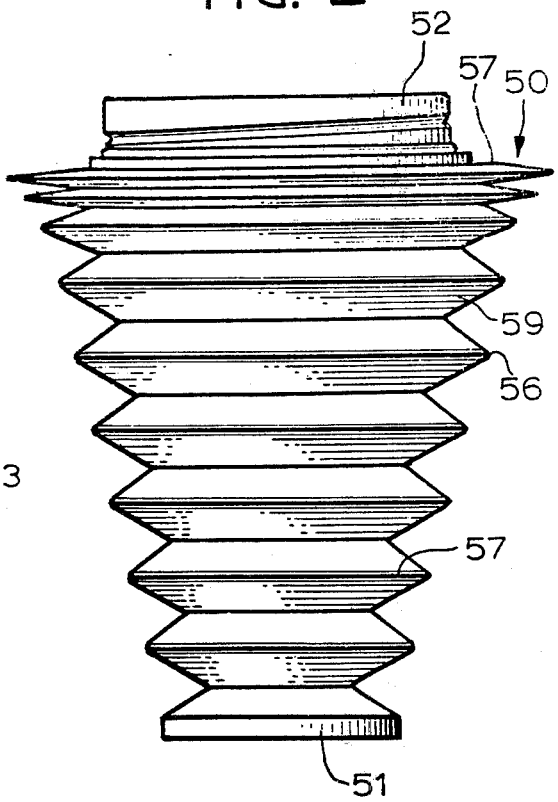
FIG. 2 is a side elevational view of the container in a partially collapsed condition.

Describing the invention in detail, and directing attention to FIG. 1, where there is shown a container generally designated 50 formed preferably of polyethylene or nylon or like plastic material which is inert to foods and possesses the characteristics of resiliency and memory to expand to its original condition.

The container 50 comprises a base 51, and upper threaded inlet neck 52 and preferably a cylindrical body generally designated 53.

The body is in the form of a truncated conical shape comprising a plurality of upper and lower segments 54, 55 which at their outer edge merge into an outwardly directed apex 56 forming folds or bellow-like pleats 57. The inner edges of each upper segment 54 merge into the inner edge of the lower segment 55 of the fold thereabove and form a bight 59 therewith (see FIG. 3). This construction tends to rigidify the structure transaxially as well as circumferentially. Thus, a volume of substance such as a liquid as well as a solid particulate material is readily contained without radial distension of the container.

As best seen in the drawings, each fold or pleat section beginning from the top is of smaller diameter than the one above and the geometry of the structure is so arranged that the diameter of the apex of each segment in its relaxed condition is larger than the next succeeding section when considered from bottom to top, and each segment diameter increases the same amount in terms of inches or fractions thereof when the segments are compressed.

The pleating or accordion shape of the body is so constructed that it tends to assume an expanded free state as seen in FIG. 1. In order to collapse the container it must be forcibly pressed down to the level of the particulate or fluid within the container. Thus the volumetric dimension of the container approximates the volume of the material within the container. As the material is depleted through the ingress-egress opening at the upper threaded inlet neck 52 the container is progressively collapsed. Inasmuch as the material composing the container is biased to expand, it will tend to do so which prevents the contents from spilling out of the container, if the container tended to collapse.

Figure 4:
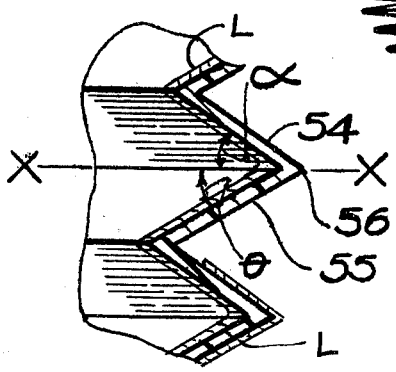
FIG. 4 is a fragmentary axial sectional view of the container.

The progressive collapsing of the container from top to bottom is a function of the truncated conical shape of the body itself and those geometric relationships as illustrated in FIG. 4. It can be seen in that figure that if a hypothetical plane X—X is constructed through any particular pleat 57 and passes through the apex 56 of that pleat the upper and lower segments 54, 55 are disposed in angular relationship to the plane X—X by angles designated $\alpha$, $\theta$ respectively. The relationship between these angles is that angle $\alpha$ is greater than angle $\theta$. Also, in one embodiment for any particular pleat 57 the upper segment 54 will have a greater length than that of the lower segment 55. However, it is also contemplated that the upper conical portion 54 may be of lesser radial length than the lower conical portion 55 thereof in order to obtain different folding characteristics. One of the principal features of the invention is in providing upper and lower section of different lengths of the pleat or fold. It also has been found that the angular differences between the two angles is approximately 5° in other words angle $\theta$ would be approximately 5° less than angle $\alpha$. . Furthermore it also has been found that the feature of progressive collapsibility from top to bottom is optimised when the angle $\alpha$ is between 35° and 36° and the angle $\phi$ is between 31° and 32° when the container is in the relaxed or fully expanded position.

In this embodiment of the invention chosen for illustration, the neck 52 is threaded at 61 and receives a closure cap 60 threaded thereon the closure cap 60 has a top portion 62 which is operative to effect a seal of an annular opening 52' with the upper annular edge of the neck 52 upon the cap 60 being threaded thereon.

In actual tests the container would, after the cap has been applied, slightly expand from its intended collapsed position and thus create a partial vacuum above the contents therein. If the cap were not turned down tight enough or if the seal was defective, the container would expand. The rapidity with which this would occur depended upon the extent of the defect in the seal. Thus, it became readily apparent to the user that the contents were not adequately protected from possible deterioration. It will be noted that the thickness of the wall section composed of segments 54, 55 of the body portion is essentially uniform in this embodiment.

It is also pointed out that since the upper most segment has the largest diameter it will have the least percentage increase of its diameter from its normal (expanded/relaxed) diameter to its compressed diameter. The increasing percentage of diameter change for each segment from top to bottom will result and, therefore, less force is required to compress any given segment from its succeeding lower segment. The arrangement follows down through the full depth of the container thus accomplishing a desired effect, and that is evacuation of air from the top of the container, and at the time that the container is empty as the product therein is being consumed.

This embodiment also shown a gas impermeable envelope designated L which is contained within the container and has a body portion 9*a* which is introduced into the container through the opening 52′. The envelope has a neck portion which fits complimentary within the opening 52′ and is connected as at to an upper edge of the neck portion by any suitable adhesive such as well known to those skilled in the art. The envelope L is comprised of a material, such as aluminum foil, which upon introduction to the container can be expanded by means, such as air, to form and conform to the internal convolutions and shape of the container in the expanded position. It is also contemplated that adhesive could be sprayed into the container before the insertion and expansion of the envelope wherein this would promote adherence of the entire envelope to the internal shape of the container. With such a liner L disposed within the container it can be appreciated that permeation of gas is minimized and, therefore, any food stuffs which would be stored therein would not be exposed to the seepage of such gas through the side walls of the container itself. It can also be appreciated that such a liner by preventing a gas permeation through the walls of the container will assure that upon collapsing the container at some position that a partial vacuum therein will be maintained. It should be understood that although a metal liner is disclosed it is contemplated that the reduction of gas permeability can be accomplished within the scope of the invention by forming a laminate from plurality of layers of thermoplastic material, one of the layers being formed from a thermoplastic resin which would exhibit high gas barrier properties such as polyvinylidene chloride, and acrylonitrile polymers. Reference is made to U.S. Pat. Nos. 3,453,173, 3,464,546, and 3,615,308 which teach such methods. Also it is contemplated that such resins such as nylon or saran which have high gas barrier properties (U.S. Pat. No. 3,093,255 and U.S. Pat. No. 3,373,224) may be used.

It is also contemplated that the liner L could be placed about the exterior of the container to accomplish similar results. If this is done the liner L is formed about the outside of the container. If the envelope L is a metalized foil, the container 50 may be inserted into said envelope and then the envelope evacuated in order to cause it to collapse against the external side walls and surfaces of the container and thereby conform to the configuration of the container itself. If necessary, adhesive could be applied to the external surfaces of the container before evacuation of the envelope is effected in order to bond the envelope through the external walls and surfaces of the container. This could be accomplished in many ways as well known to those skilled in the art. However, if a plastic gas barrier media is used, such as heretofor described in connection with the previous embodiment, such material may be applied either by spraying or by coextrusion during the injection molding proceedures forming the container.

Figure 3:
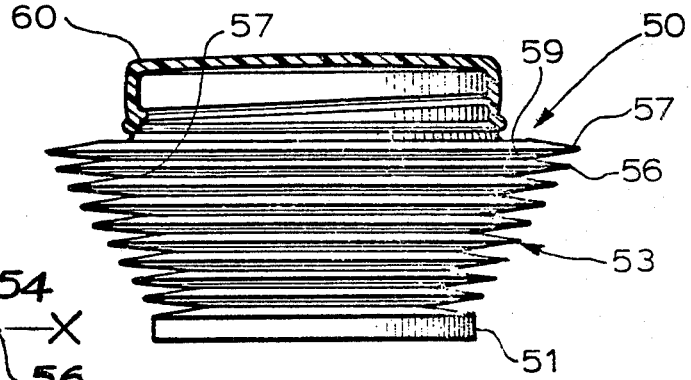
FIG. 3 is a side elevational view of the container in collapsed condition.

It can be appreciated that the embodiments heretofor described show containers which are so constructed to collapse from the top in a progressive manner toward the bottom of the container. This feature follows down through the full depth of the container thus accomplishing an evacuation of air from the top to the bottom of the container, and also providing a method by which the container may be selectively reduced in volumetric dimension to the level of unused product or condiment contained therein. In other words, as a product is withdrawn from the top of the container, that portion being more flexible that the portions below, it can be collapsed as seen in FIG. 3 and the cap screwed on. The interior volume of air above the level of the product is thus reduced to the minimum, which retards spoilage.

This sequence of container compression is extremely important, because considering the broad application of this type of container and the various types of products to be preserved in a partial vacuum, it is best not to disturb the contents in the area of the container below the level of usage.

For example, it is best not to disturb certain jellies or preserves below the level of usage to avoid chances of spoilage from excessive exposure to air.

Another example is when containing fragile articles such as potato chips, crackers, cookies, etc., compression of segments in increments from top to bottom will allow evacuation of air from the container to the level of the contents without wedging against and fracturing the contents in the lower portions of the container.

It will be appreciated that the embodiments of the invention heretofor described were chosen for the purpose of illustration and description and, therefore, are preferred based upon requirements for achieving the objects of the invention and developing the utility thereof in the most desirable manner, due regard being had to existing factors of economy, simplicity of design and construction, production methods and improvements saught to be effected. It will be understood, that the particular structure and functional aspect emphasized herein are not intended to exclude but rather to suggest such other modifications and adaptations as fall within the spirt and scope of the invention as defined in the appended claims:

What is claimed is:

1. A hermetically sealable container comprising; a self-expanding body having an access opening at the top and a base at the bottom thereof; said body comprising at least one fold disposed between said top and base and having upper and lower fold portions of substantially uniform thickness joined in an outwardly directed apex; and said upper fold portion being of different radial length than said lower fold portion and said fold being characterized by increased rigidity from the upper to the lower portions thereof whereby upon pressure being applied to the top of said container, said body will collapse progressively from the top to the bottom thereof.

2. The invention as recited in claim 1 wherein an angle between the upper portion and a hypothetical plane passing through the apex is greater than the angle between the lower portion and said plane.

3. The invention as recited in claim 1 wherein the upper portion of each fold is of greater radial length than the lower portion thereof.

4. A hermetically sealable container comprising: a self-expanding body having an access opening at the top and a base at the bottom thereof; said body comprising a plurality of pleats successively connected from the top of the container to the bottom thereof, and each pleat having upper and lower converging portions of substantially uniform thickness joined in an outwardly directed apex; each pleat defining a progressively decreasing transaxial cross-sectional area from top to bottom of the container, and the upper portion of any particular pleat having a greater length than the corresponding lower portion of that same pleat radially of the container, and each pleat having less flexibility than one thereabove whereby said pleats progressively collapse from top to bottom of said container upon a load being applied to the top thereof.

5. The invention as recited in claim 4 wherein an angle between the upper portion of any particular pleat and a hypothetical plane passing through the apex of that pleat will be greater than an angle between the corresponding lower portion and the same plane.

6. The invention according to claim 5 and said body being shaped as an inverted truncated cone.

7. The invention as recited in claim 6 wherein said body comprises a neck portion circumferentially disposed about said access opening, and closure means releasably connectable to said neck portion operative to seal the container thereat.

8. The invention as recited in claim 7 wherein said pleats being foldable axially of the container, said body being held in collapsed condition by vacuum developed in the container attendant to expansion of the container to a state of equilibrium upon said closure means sealing the access opening of the container.

9. The invention as recited in claim 8 wherein said body defines internal and external surfaces, means disposed about at least one of said surfaces effective to prohibit the permeation of gas through the walls of the container.

10. The invention as recited in claim 9 wherein said means comprises an envelope having high gas barrier properties, and said envelope disposed in nestling relationship on at least one of said surfaces.

11. The invention as recited in claim 10 wherein the surface on which said envelope is disposed is treated with an adhesive to promote conformation of said envelope to the pleats and shape of the container.

12. The invention as recited in claim 11 wherein said container is constructed of polyethylene.

13. A hermetically sealable container comprising a self-expanding structure of plastic material with an access opening, a reusable closure adapted to seal said opening, said structure comprising a bellows-like body adapted to be compressed to bring said access opening to the level of the product therein to proportion the volumetric dimensions of the interior of the container to approximately the volume of the contents therein such that as the contents are depleted the container size is reduced to approximately the volume of the remainder of the contents, and said container adapted to be hermetically resealed in such collapsed condition by application of the closure, said body characterized in being self-expandable to original dimension if an air leak occurs, whereby indicating deficiency of the seal to the user, said container comprising folds having sections of progressively decreasing compressibility from top to bottom of said container, and said folds formed and arranged in an axial series and said folds from top to bottom of the container being progressively less compressible, and said section of each of said folds being formed by opposing upper and lower truncated conical portions joined in an outwardly directed apex and adjacent portions of respective sections merging into bights, the apex of each fold from top to bottom of the container being disposed outwardly of the one therebelow, the upper conical portion of each fold being of lesser radial length than the lower conical portion of the fold.

14. The invention according to claim 13 and a threaded neck about said opening integral with said wall structure and said closure comprising a cap threaded onto said neck.

15. The invention according to claim 14 and said folds being foldable axially of the container, said body being held in collapsed condition by vacuum developed in the container attendant to expansion of the container to a state of equilibrium, and said bights being offset inwardly of each other from top to bottom of the container.

16. The invention according to claim 15 and said portions of all of said folds being of the same thickness from top to bottom of the container.

17. The invention as recited in claim 16 wherein said body defines internal and external surfaces, means disposed about at least one of said surfaces effective to prohibit the permeation of gas through the walls of the container.

18. The invention as recited in claim 17 wherein said means comprises an envelope having high gas barrier properties, and said envelope disposed in nestling relationship on at least one of said surfaces.

19. The invention as recited in claim 18 wherein the surface on which said envelope is disposed is treated with an adhesive to promote conformation of said envelope to the convolutions and shape of the container.

20. The invention as recited in claim 19 wherein said container is constructed of polyethylene.

* * * * *